US006286834B1

(12) United States Patent
Caputo

(10) Patent No.: US 6,286,834 B1
(45) Date of Patent: Sep. 11, 2001

(54) METHODS AND APPARATUS FOR PLAYING WAGERING GAMES

(75) Inventor: Scott A. Caputo, Mountain View, CA (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 09/618,880

(22) Filed: Jul. 19, 2000

Related U.S. Application Data

(60) Provisional application No. 60/145,290, filed on Jul. 23, 1999.

(51) Int. Cl.[7] ..... A63F 9/04
(52) U.S. Cl. ..... 273/274; 273/146
(58) Field of Search ..... 273/274, 292, 273/146

(56) References Cited

U.S. PATENT DOCUMENTS 5,513,850 * 5/1996 Vancura .
5,556,101 * 9/1996 Jabro .
5,964,463 * 10/1999 Moore .
6,062,563 * 5/2000 De Keller .
6,173,955 * 1/2001 Perrie et al. .

OTHER PUBLICATIONS

Scarne's Encyclopedia of Card Games, 1973, 1983, pp. 450–451.

* cited by examiner

*Primary Examiner*—William M. Pierce
(74) *Attorney, Agent, or Firm*—Marshall, O'Toole, Gerstein, Murray & Borun

(57) ABSTRACT

In methods for playing wagering games, a player is afforded an opportunity to place a wager, and then the dealer rolls four dice and sums the total to obtain the dealer's score. The player is then afforded an opportunity to select to roll one, two, three, or four dice in an effort to beat the dealer's score. The player then rolls the selected number of dice, and sums the total to obtain the player's score. If the player's score is greater than the dealer's score, the player wins the wager according to a predetermined pay table, with fewer dice rolled to beat the dealer's score resulting in higher monetary awards.

Apparatus for playing wagering games is also disclosed.

35 Claims, 5 Drawing Sheets

METHODS AND APPARATUS FOR PLAYING WAGERING GAMES

This application is based upon a provisional application filed on Jul. 23, 1999 with a Ser. No. 60/145,290, and is hereby incorporated by reference.

BACKGROUND OF THE INVENTION

1. Field of the Invention

The present invention relates to wagering games, and more particularly pertains to wagering games of the type adapted for play in live table and video machine versions in casinos, in Internet casinos, and on personal computers.

2. Description of the Prior Art

In a prior art wagering game known by the various names of Beat the Dealer, Beat the Shake, Beat the Banker, High Dice, and Two Dice Klondike, the dealer rolls one or more dice and sums the total to get the dealer's score. The player then attempts to beat the dealer by rolling the same number of dice in an effort to obtain a higher score. However, the player loses if his score is less than or equal to the dealer's score. The game is described in *Scarne's Encyclopedia of Card Games*(© 1973, 1983 John Scarne Games, Inc.) at page 450, a copy of which is filed with the instant application and incorporated herein by this reference thereto.

SUMMARY OF THE INVENTION

The present invention provides methods for playing wagering games in which a player is afforded an opportunity to place a wager, and then the dealer rolls four dice and sums the total to obtain the dealer's score. The player is then afforded an opportunity to select to roll one, two, three, or four dice in an effort to beat the dealer's score. The player then rolls the selected number of dice, and sums the total to obtain the player's score. If the player's score is greater than the dealer's score, the player wins the wager according to a predetermined pay table, with fewer dice rolled to beat the dealer's score resulting in higher monetary awards. The present invention also provides apparatus for playing wagering games.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described preferred embodiments of the invention.

DETAILED DESCRIPTION OF THE PREFERRED EMBODIMENT(S)

Figure 1:
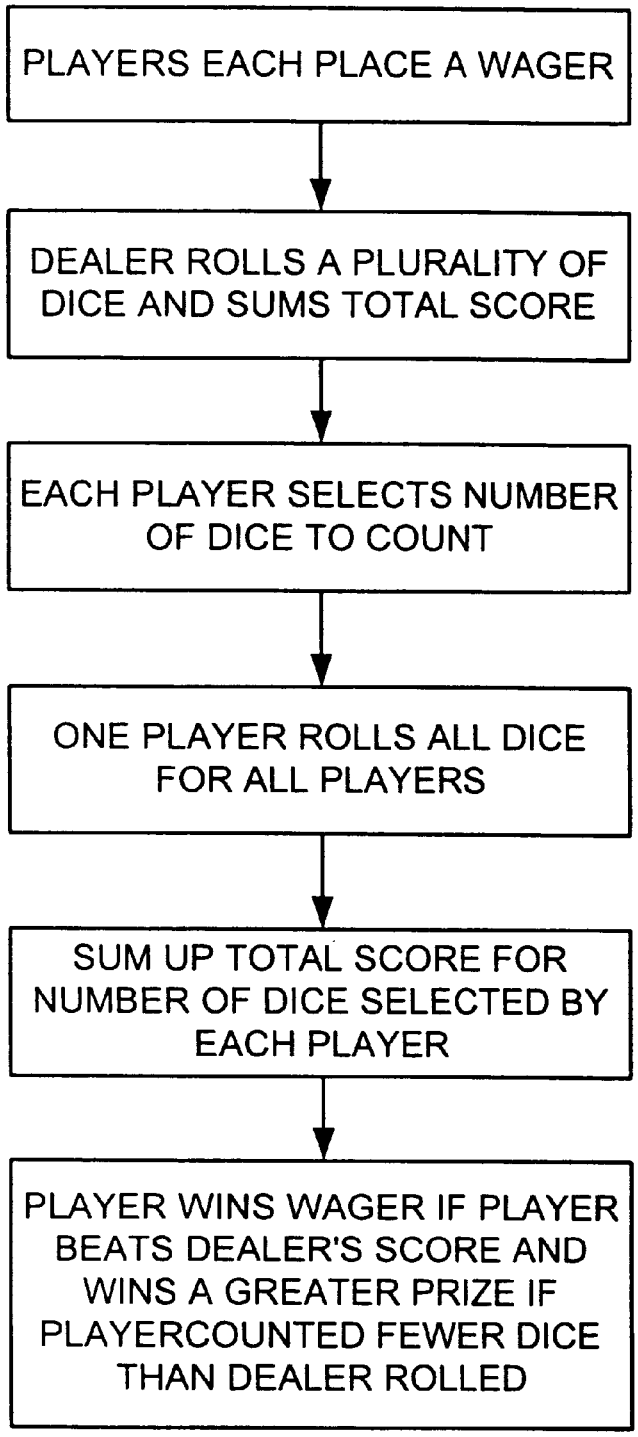
FIG. 1 is a flow chart illustrating the steps in playing a wagering game according to an exemplary embodiment of the present invention.

Referring now to FIG. 1, a method of playing a wagering game according to an exemplary embodiment of the invention will be described. The game preferably uses conventional, six-sided, cubic dice, although dice having other configurations are also contemplated within the scope of the present invention.

A player is first afforded an opportunity to place a wager. A dealer then rolls four dice and sums the total number of spots showing (preferably showing on the face up side of each die) to obtain the dealer's score. The player is then afforded an option to select a number of from one up to and including four dice to roll. That is, the player may choose to roll either one, two, three, or four dice. Although preferably the player selects the number of dice to roll after learning the dealer's score, it is contemplated within the scope of the invention that the selection must be made prior to learning the dealer's score. The player's score is preferably calculated in a like manner by summing the total number of spots showing (preferably on the face up side of each die). If the player's score is higher than the dealer's score, the player wins a prize from a predetermined pay table, which provides for higher prizes for fewer dice rolled. For example, if the dealer rolled four dice and obtained 1, 2, 3, and 4 spots on the face up sides of each die, respectively, for a score of ten, a player that opted to roll two dice and obtained 6 and 6 for a score of twelve would win, and would win a prize greater than a player that opted to roll three dice and obtained 4, 4, and 4 for the same score of twelve.

The game may be played by one or more players, in electronic video versions, on a personal computer, on the Internet, or in live casino table game versions. Instead of dice, other ranked indicators such as tiles, cards or other indicators or tokens may be used. Such ranked indicators or tokens may comprise tangible physical objects, or electronic representations appearing on an electronic video gaming device or computer monitor.

In a live casino table game version of the game, an electronic die/dice scanner or reader may be employed. For example, such readers as are disclosed in U.S. Pat. Nos. 4,909,513; 5,694,045; 5,770,553; and 5,885,157, the disclosures of which are incorporated herein by reference, might be utilized. The reader could be located below the table surface, which might include a flat, transparent plate upon which the die/dice are to be rolled, with the reader observing the face down side of each die and thereby inherently knowing the face up side of that die. The reader could also be operatively connected to a microprocessor that counts the number of dice and sums the total sum of the dice, i.e, the score achieved for a particular number of dice rolled. With such an embodiment, the dealer's score or the player's score could be displayed on an electronic sign adjacent to the table layout and a player's winning score could be flashed. Various wagering areas on the table layout might be lighted whenever the wager wins.

The present invention contemplates several variants and modified embodiments of the inventive game, as set forth below. The various alternative options discussed herein may be employed alone, or in any combination or permutation.

Lower Score

Instead of beating the dealer with a higher score, the objective may be to obtain a lower score than the dealer. In this variant, the player will obtain a greater prize if he elects to roll a greater number of dice, while still obtaining a lower total score than the dealer.

Player or Dealer Selects Number of Dice to be Rolled by the Dealer

Instead of always rolling four dice, either the player or the dealer may be provided with the option of selecting how many dice the dealer rolls. For example, the dealer may elect to roll two, three, four, five, or six dice to obtain the dealer's score. In this variant, the player would still have the option of selecting the number of dice the player rolls to make a score up to the number of dice the dealer used.

Side Bets

In addition to the wager resolved based upon whether the player beats the dealer's score, players may be afforded options to place one or more side bet wagers. Side bets could include field bets as in conventional Craps, or be resolved based upon whether the dice score is a sum greater than a certain number, less than a certain number, or equal to a certain number. Other side bets may be based upon rolling certain predetermined winning dice relationships such as two, three, four, five, or six of a kind, a full house, or two, three, four, five, or six sequential numbers in a row. Other possible side bets include all dice rolled having a unique number, or various combinations of other winning arrangements. Yet other side bets may be based upon the score of either the dealer or the player in sequential games, for example, if the dealer rolls all 6s in three sequential games. The side bets may be resolved based upon the player's score, the dealer's score, or some combination of both the player's and dealer's roll. In live casino versions of the game, a felt layout or table covering may bear indicia for designating the various available side bets, as in the manner of conventional Craps.

Non-Shooting Players

In another contemplated option, non-shooting players may be afforded opportunities to place both wagers and side bets, as in the manner of conventional Craps.

Player Designated Number of Dice

In still another embodiment, a player always rolls the same number of dice rolled by the dealer, but designates the number of dice rolled to count toward the player's score. The dice may bear identifying indicia, such as color coding, to designate the dice to be counted. For example, six dice could bear the colors red, blue, green, yellow, black, and orange, with the number of dice designated by the player counted in a predetermined order according to color. Alternatively, dice may be given alpha, numeric, or alpha-numeric identifying indicia. As still another alternative, dice may be contained and rolled in separate chambers to designate the order of counting. In another embodiment, the dice may be rolled or revealed in a particular order. In still another alternative, a player may select particular dice to be counted, either before or after the dice are rolled.

In yet another embodiment, the score of a lesser number of dice than the number of dice rolled may be used to calculate a score. For example, if a player rolls five dice, the sum total of the spots of the four dice having the lowest score may be used to calculate a score.

Automatic Winning Roll

In addition to beating the dealer's score, a certain rolled dice combination may be designated as always winning for a player or as entitling the player to receive a separate bonus or prize, regardless of the player's score. For example, four sixes, or four of a kind, etc. Certain dealer rolls may also be designated as unbeatable.

Table Layout Designs and Apparatus for use with the Game

Figure 2:
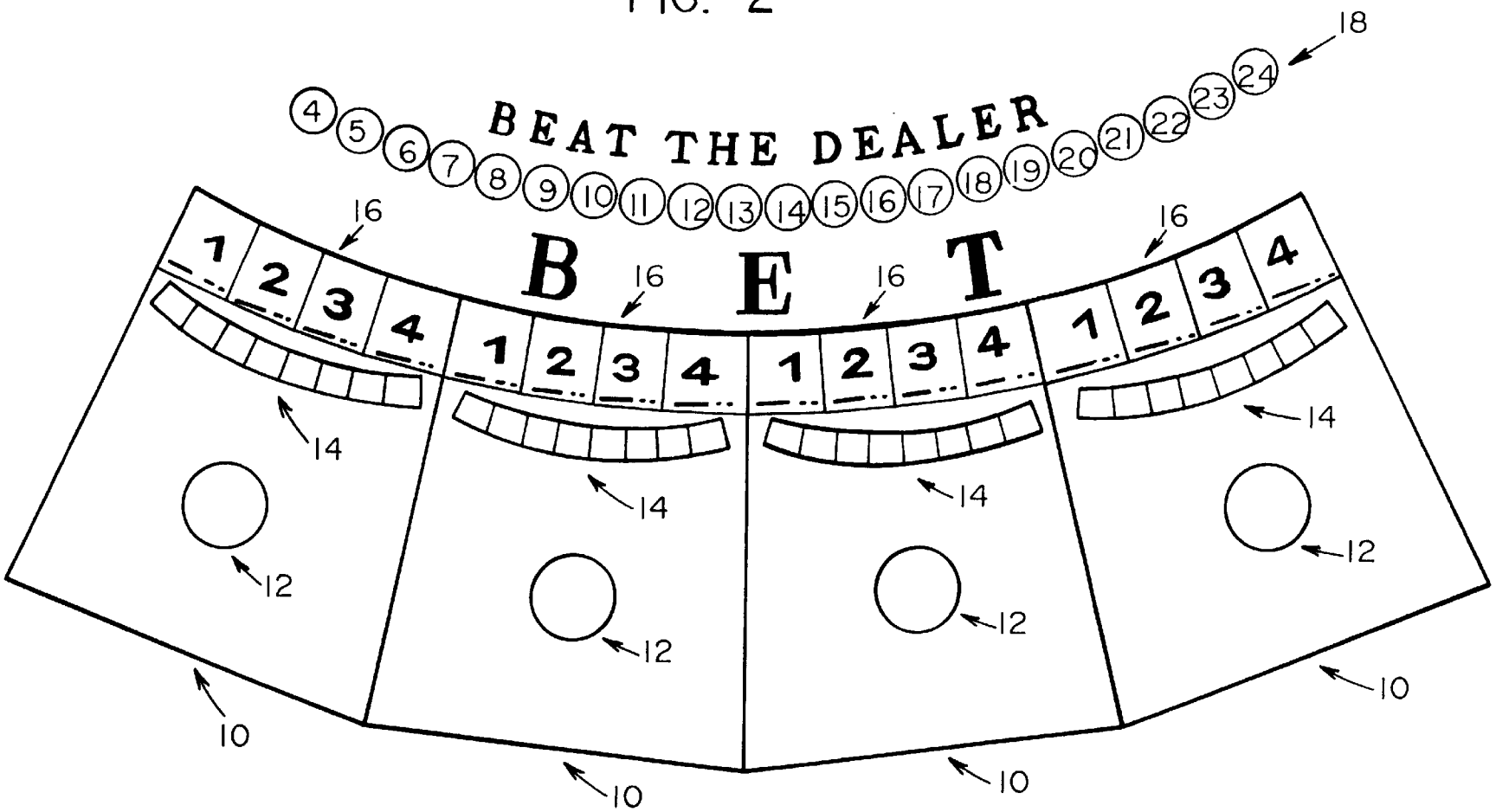
FIG. 2 illustrates a portion of a table layout that may be used in connection with an exemplary embodiment of present invention.
Figure 3:
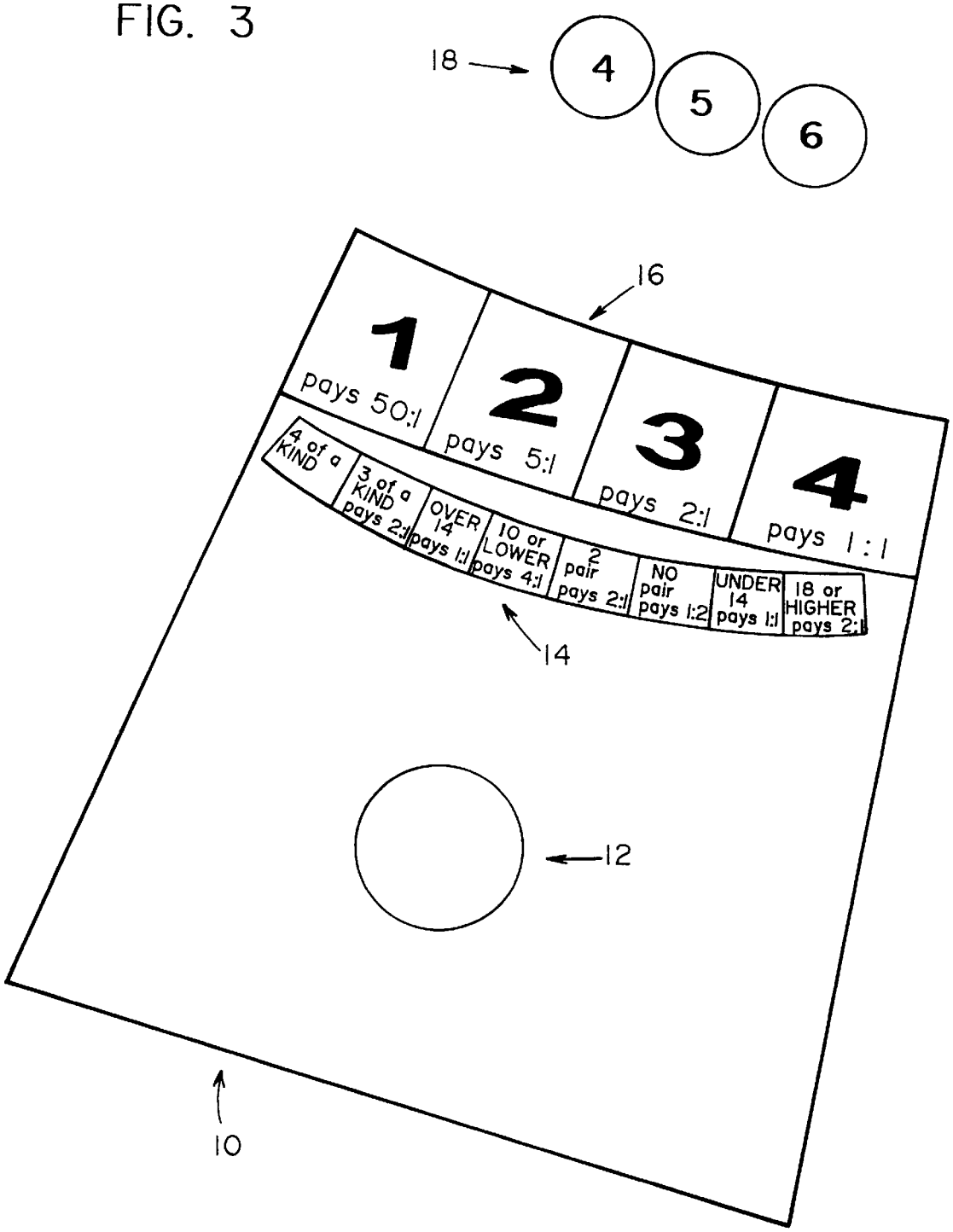
FIG. 3 is a larger view of a portion of the table layout shown in FIG. 2.

FIGS. 2 and 3 illustrate a table layout that may be used in connection with other various embodiments of the present invention. The layout shows four player locations 10 generally arranged in an arcuate fashion, as is customary with conventional live casino tables. Although four player positions are shown, any number of player positions, typically ranging from one to seven player positions, may be employed. Such a table layout may be depicted on a video screen, in which embodiment, preferably there would be only one player location.

Each player location 10 includes a primary wagering area or spot, such as the circle 12, includes a side bet wagering area or spot 14, and includes a secondary wagering area or spot 16. The table layout further includes a series of numbers 18 ranging from four to twenty-four, each of which is encircled and each which represents a potential dealer's score. The dealer's score indicating numbers 18 are also arranged in an arcuate fashion generally concentrically arranged with the arcuately arranged player locations 10.

In operation, each player places a wager in the betting spot 12 prior to the dealer's roll. The wager may be in the form of chips, tokens, coins, cash, or any other thing of value. Also the wager may be placed through electronic systems such as player debit cards and credit cards, with the player manipulating electromechanical devices to indicate the value of the wager being placed. After the player is afforded an opportunity to place a wager, the dealer then rolls preferably four dice, and the dealer's score is designated by placing a marker or the like on the corresponding dealer's score indicating number 18. The player may then decide to place all of his primary wager on any one of the subregion numbers 1, 2, 3, and 4 in the secondary wagering spot 16, or alternatively, the player may place any portion of his primary wager on any one of the four subregion numbers. In the live casino table game embodiment, preferably only the dealer handles the player's wager and places it in the secondary wagering spot 16, as designated and selected by the player. Such a procedure helps ensure that a player does not illegally palm additional wagers onto or detract wagers from his wagers initially placed in the betting spot 12. In the video versions of the game, the player may manually activate electromechanical buttons, which buttons show the player's wager being placed in betting spot 16, as designated and selected by the player.

After the wagers have been appropriately placed in the secondary wagering spot 16, the player rolls the dice. A player may roll on behalf of himself and the other players. The player selected to roll the dice may rotate around the player positions, starting with the player on the dealer's left, whereby after each game, the roll is passed to the next player. A player may choose to "pass" the roll. Alternatively, a random mechanism may be used for selecting the player who rolls the dice.

Although it is contemplated within the scope of the present invention that a player may handle the dice, preferably only the dealer handles the dice, with the player manipulating a container for shaking and discharging the dice onto a designated dice receiving area. By having only the dealer handle the dice, the risk is minimized that a player might illegitimately substitute shaved or otherwise unconventional dice. Further alternatively, only the dealer might handle, shake, and discharge the dice for purposes of the player's roll.

Figure 4:
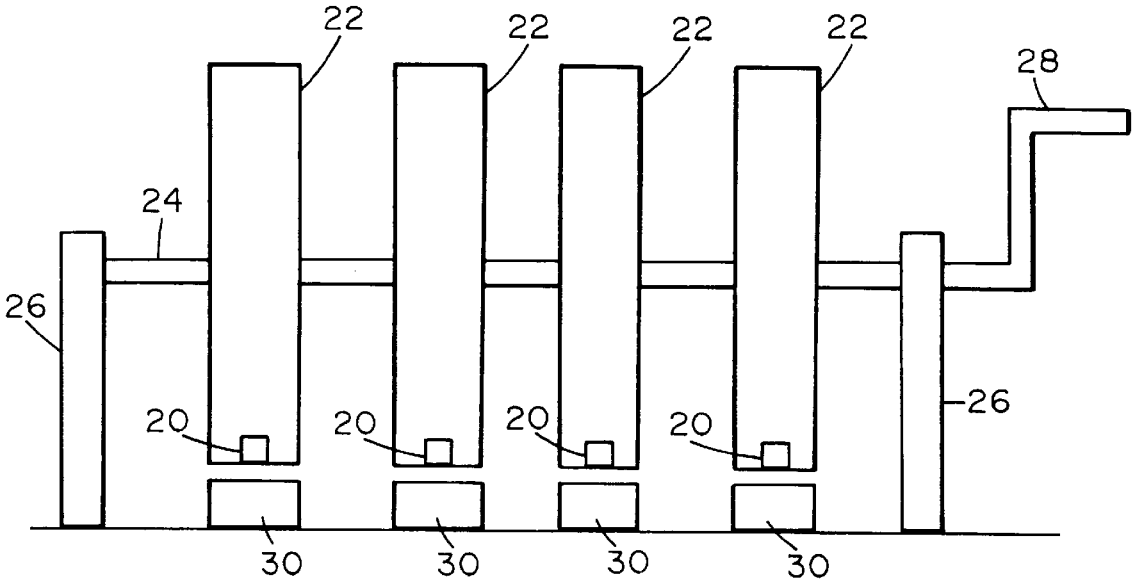
FIG. 4 is a side, schematic view of a dice rolling mechanism that may be used in connection with the games of the instant invention.

The roll may comprise placing the dice in a cup, shaking the cup, and turning the cup upside down to discharge the dice onto a dice receiving area. In another embodiment as shown in FIG. 4, each die 20 may be placed within a transparent, hollow, substantially cylindrical tube 22 having closed longitudinal ends, with a flat interior surface on each end. The tubes 22 may be vertically oriented and fixedly mounted on a substantially horizontally extending rod 24 connected to each tube generally midway along the length of each tube 22. The rod 24 may be mounted and suspended by means of conventional bearings in mounting brackets 26. By rotating the horizontal rod 24, such as by means of a hand crank 28 or a selectively activated motor, the die 20 in each tube 22 tumbles from one end to the other end. A die/dice scanner/reader3 0 is disposed on the table top immediately vertically beneath each tube 22 when the tube 22 is disposed in a vertical orientation. As such, after the rod 24 is rotated by means of the crank 28 whereby the tubes 22 rotate about a substantially horizontal axis and whereby the die 20 in each tube tumbles, and when the tubes 22 are then arranged in a vertical orientation, each die/dice reader/scanner 30 is able to determine the spots on the face down side of each die 20 and thereby inherently knows the spots on the face up side of each die 20.

Figure 6:
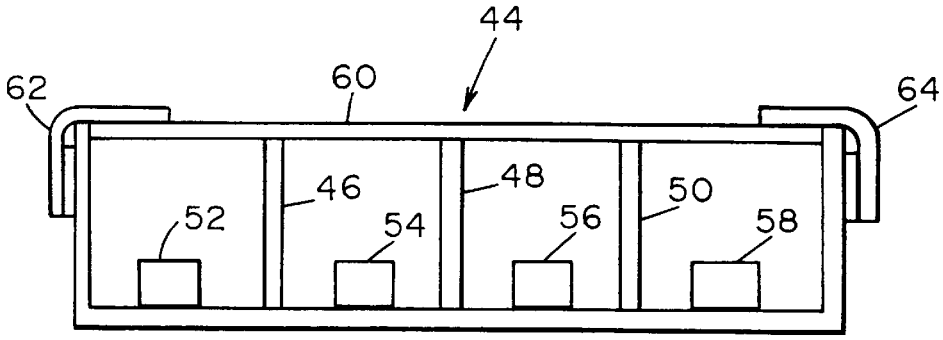
FIG. 6 is a side, schematic view of a dice shaker that may be used in connection with this games of the present invention.

There is shown on FIG. 6 a dice shaker 44 that may be employed with the games of the present invention. The shaker 44 is generally rectangular in configuration from top, bottom and side views and is generally square from an end view. The interior of the shaker is generally hollow with four, equal distantly spaced interior walls 46, 48, 50 dividing the interior into four cubic compartments. One of four dice 52, 54, 56, 58 is disposed in an associated one of each of the four compartments. The shaker walls are preferably each formed of a clear substance so that the dice 52, 54, 56, 58 may be easily viewed. Alternatively the bottom wall may be color coded with a distinguishing color for each associated dice, or the side walls may be alphanumerically encoded such as with one of the letters, A, B, C, and D adjacent each compartment. The top cover 60 preferably is selectively removable or may be selectively operable such as by means of a hinge (not shown). The remaining walls of the shaker 44 are preferably fixedly, permanently secured to each other. The top cover 60 may be selectively secured to the shaker 44 by means of Velcro® hook and log fasteners members 62, 64 disposed at each longitudinal end of the shaker 44 when the die 52, 54, 56, 58 are in their respective compartments and the top cover 60 is secured to the shaker 60, the shaker 44 may be shaken to shake the dice and then placed with the bottom wall against a table top or other surface for a dice roll.

Figure 7:
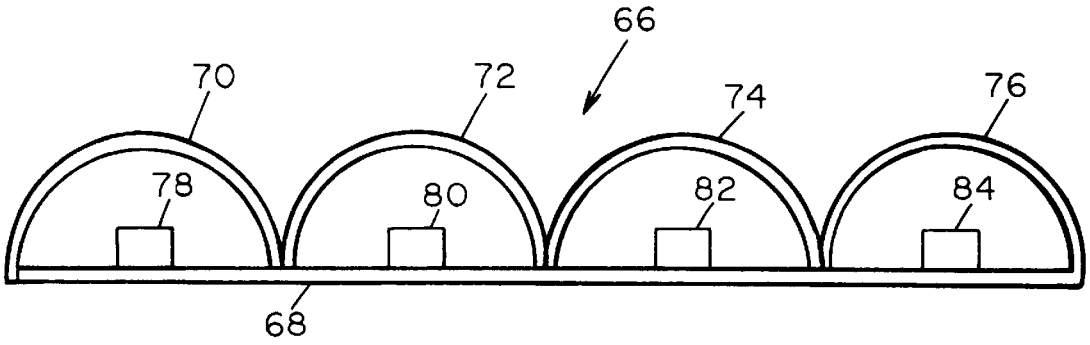
FIG. 7 is a side, schematic view of another dice shaker that may be used in connection with the games of the present invention.

Another dice shaker 66 that may be utilized in the present invention is shown in FIG. 7. The dice shaker 66 includes a planner base 68 upon which are mounted four semi-spherical bubbles 70, 72, 74, 76 each containing an associated one of four dice 78, 80, 82, 84. The bubbles 70, 72, 74, 76 are preferably furnished of clear material and preferably permanently secured to the base 68. The base 68 may be color coded. The shaker 66 may be shaken and then placed with the base 68 against a table top or other surface to achieve a dice roll.

The dice may be provided with an indicia such as different colorings or alpha-numeric designations for the purpose of determining the die or dice used to determine the player's score. For example, if each die bears a corresponding one of the letters A, B, C, and D, the number of spots on the face-up side of die A will be used to determine the player's score where the player has any wager placed on the subregion number 1 in the secondary wagering area 16. The sum total of the spots of the face-up sides of dice A and B will be used to determiner the player's score for purposes of resolving the wagers on the subregion designated 2 in the secondary wagering area 16, and so forth. In an alternative embodiment, the die with the lowest (or highest) number of spots may be utilized to determine the player's score for wagers on the subregion designated 1 in the secondary wagering area, the two dice with the lowest (or highest) sum total of spots may be utilized to determine the player's score for wagers on the subregion designated 2 in the secondary wagering area 16, and so forth. The payout odds are printed on the table layout for each of the four subregions of secondary wagering area 16.

As shown in FIGS. 2 and 3, the table layout also includes a side bet wagering area 14 which includes a series of subregions, some of which indicate a particular range of scores or certain predetermined winning dice relationships. Again, the payout odds are printed on the table layout with respect to each subregion in the side bet wagering area 14. The player may place any chosen value of wager for any one or more of the subregions in a side bet wagering area 14 by placing the chosen wager on a selected one or ones of said subregions. If the side bet is based upon the outcome of the dealer roll, then the side bet wagers must be placed before the dealer roll; if the side bet wagers are based upon the outcome of the player roll, then the side bet wagers must be place some time prior to the player roll, and preferably even prior to the dealer roll. The side bet wagers are resolved after the associated dealer or player roll of the dice.

Figure 5:
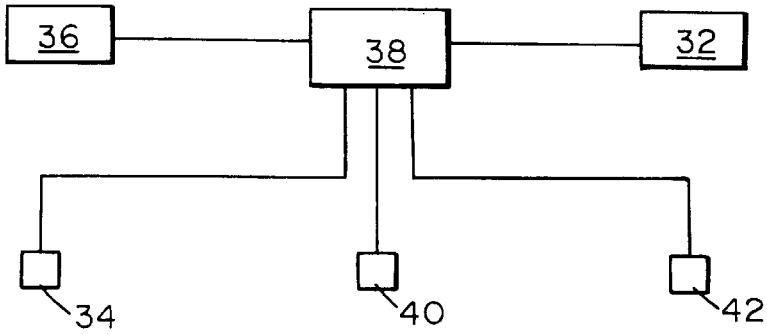
FIG. 5 is a schematic diagram of a dice reader, computer, and lighting system that may be used in connection with the games of the present invention.

As illustrated in FIG. 5, the dealer's score may be designated by an electro-mechanical system by which a dealer manually depresses a button 32 which causes the appropriate dealer score indicating number 18 to light up, such as by means of a light 34 disposed beneath a transparent or translucent plate on which the number is printed. Alternatively, or additionally, the dealer's score may be displayed on an electronic sign adjacent to the table. In this latter embodiment, the dealer's score may be displayed by the dealer's manual manipulation of a button electronically interconnected to the sign, or may be displayed through appropriate electronic circuitry associated with a dice reader, as previously disclosed.

In a further embodiment of the present invention, as shown in FIG. 5, the dice reader 36 may be interconnected to a computer 38 such that the computer records the dealer's score and then compares the dealer's score with the player's score and through appropriate electronic circuitry lights none, one, or more of the four subregion areas of the secondary wagering area 16 to designate which of the wagers in those subregion areas are winning wagers. The areas may be lighted by means of four light bulbs 40 disposed under a translucent plate constituting the corresponding subregion area. The translucent plates may be different colors for each subregion area. By providing such lighting, not only will the player's excitement and enjoyment of the game be enhanced, but also the dealer will be able to more quickly and accurately determine which wagers are winning wagers and which are losing wagers. Likewise, the subregion areas of the side bet wagering area 14 could be lighted by means of light bulbs 42 to show winning side bets.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts or types of material within the principles of the invention to the full extent indicated by the broad general meaning of the terms in which the appended claims are expressed.

What is claimed is:

1. A method of playing a dice game, comprising:

affording at least one player an opportunity to place a wager;

a dealer rolling a number comprising a plurality of dice and summing the total to obtain a dealer's score;

affording said player an opportunity to select and roll a number of dice from one up to and including said number of dice rolled by said dealer;

summing the total rolled by said player to obtain the player's score; and settling said wager by paying to said player a prize if the player's score is higher than the dealer's score, wherein said prize is a greater amount if said player opted to roll fewer dice than the dealer rolled.

2. The method of claim 1, wherein said number of dice rolled by said dealer is four.

3. The method of claim 1, wherein said wager is settled according to a predetermined pay table.

4. The method of claim 1, further comprising the step of said dealer selecting said number comprising a plurality of dice to roll.

5. The method of claim 4, wherein said dealer may select to roll two, three, four, five or six dice.

6. The method of claim 1, further comprising the step of affording said player an opportunity to place at least one side bet in addition to said wager.

7. The method of claim 6, wherein said side bet is settled based upon a predetermined winning relationship of dice rolled by said dealer.

8. The method of claim 6, wherein said side bet is settled based upon a predetermined winning relationship of dice rolled by said player.

9. The method of claim 6, wherein said side bet is settled based upon a predetermined winning relationship of dice rolled by said dealer and said player.

10. The method of claim 6, wherein said side bet is won by a rolled dice sum less than a predetermined number.

11. The method of claim 6, wherein said side bet is won by a rolled dice sum greater than a predetermined number.

12. The method of claim 6, wherein said side bet is won by a rolled dice sum equal to a predetermined number.

13. The method of claim 6, wherein said side bet is won by a plurality of rolled dice each having a unique rolled number.

14. The method of claim 6, wherein said side bet is won by a plurality of rolled dice each having the same rolled number.

15. The method of claim 6, wherein said side bet is won by a plurality of rolled dice forming one of a plurality of different predetermined winning relationships.

16. The method of claim 15, wherein said predetermined winning relationships comprise a pair, two of a kind, three of a kind, four of a kind, five of a kind, six of a kind, two sequential numbers, three sequential numbers, four sequential numbers, five sequential numbers, six sequential numbers, two pair, three pair, and a full house.

17. The method of claim 1, wherein a predetermined winning combination of dice rolled by a player always beats the dealer, regardless of the dealer's score.

18. The method of claim 17, wherein said predetermined winning combination of dice comprises four of a kind.

19. The method of claim 1, further comprising the step of affording at least one non dice rolling player an opportunity to place a wager based upon the outcome of said player's dice roll.

20. The method of claim 1, further comprising the step of affording at least one non dice rolling player an opportunity to place a wager based upon the outcome of said dealer's dice roll.

21. The method of claim 1, further comprising the steps of affording a plurality of players an opportunity to participate in said game.

22. The method of claim 1, wherein said game is played with a live human dealer.

23. The method of claim 22, further comprising a layout bearing indicia for designating the placement of wagers.

24. The method of claim 1, wherein said game is played on an electronic video gaming device.

25. The method of claim 1, wherein said game is placed on a personal computer.

26. The method of claim 1, wherein said game is played over the Internet.

27. A method of playing a dice game, comprising:

affording at least one player an opportunity to place a wager;

a dealer rolling a number comprising a plurality of dice and summing the total to obtain a dealer's score;

affording said player an opportunity to select and roll a number of dice from one up to and including said number of dice rolled by said dealer;

summing the total rolled by said player to obtain the player's score; and settling said wager by paying to said player a prize if the player's score is lower than the dealer's score, wherein said prize is a greater amount if said player opted to roll a greater number of dice than the dealer rolled.

28. A method of playing a dice game, comprising:

affording a player an opportunity to place a wager;

a dealer rolling a number comprising a plurality of dice and summing the total to obtain a dealer's score;

affording said player an opportunity to designate a number of dice to count toward the player's score from one up to and including said number of dice rolled by said dealer;

affording said player an opportunity to roll said number of dice rolled by said dealer;

summing the total of said designated number of dice to count rolled by said player to obtain the player's score; and settling said wager by paying to said player a prize if the player's score is lower than the dealer's score, wherein said prize is a greater amount if said player designated to count a greater number of dice than the dealer rolled.

29. The method of claim 28, wherein said dice bear unique identifying indicia to identify said designated number of dice to count.

30. The method of claim 29, wherein said identifying indicia comprises differently colored dice.

31. The method of claim 28, wherein said dice are contained and rolled within separate chambers to identify said designated number of dice to count.

32. The method of claim 28, wherein said dice when rolled are revealed one at a time to identify said designated number of dice to count.

33. The method of claim 28, wherein said player selects which dice to count after they are rolled.

34. The method of claim 28, wherein said player selects which dice to count before they are rolled.

35. A method of playing a dice game, comprising:

affording a player an opportunity to place a wager;

a dealer rolling a number comprising a plurality of dice and summing the total to obtain a dealer's score;

affording said player an opportunity to designate a number of dice to count toward the player's score from one up to and including said number of dice rolled by said dealer;

affording said player an opportunity to roll said number of dice rolled by said dealer;

summing the total of said designated number of dice to count rolled by said player to obtain the player's score; and settling said wager by paying to said player a prize if the player's score is greater than the dealer's score, wherein said prize is a greater amount if said player designated to count a fewer number of dice than the dealer rolled.

* * * * *